US009924848B2

(12) United States Patent
Hopkins

(10) Patent No.: US 9,924,848 B2
(45) Date of Patent: Mar. 27, 2018

(54) TUNGSTEN JEWELRY RESURFACING KIT FOR CONSUMER END USE AND TUNGSTEN RESURFACING COMPOUND USED THEREIN

(71) Applicant: Samuel P Hopkins, Freedom, PA (US)

(72) Inventor: Samuel P Hopkins, Freedom, PA (US)

( * ) Notice: Subject to any disclaimer, the term of this patent is extended or adjusted under 35 U.S.C. 154(b) by 990 days.

(21) Appl. No.: 13/751,241

(22) Filed: Jan. 28, 2013

(65) Prior Publication Data

US 2014/0213161 A1 Jul. 31, 2014

(51) Int. Cl.

| | |
|---|---|
| ***B24B 1/00*** | (2006.01) |
| ***B24D 15/00*** | (2006.01) |
| ***A47L 13/16*** | (2006.01) |
| ***B24D 99/00*** | (2010.01) |
| ***A47L 25/00*** | (2006.01) |
| *A44C 27/00* | (2006.01) |

(52) U.S. Cl.

CPC ..... *A47L 13/16* (2013.01); *A47L 25/00* (2013.01); *B24D 15/00* (2013.01); *B24D 99/00* (2013.01); *A44C 27/006* (2013.01)

(58) Field of Classification Search

CPC ..... B24D 15/00; B24D 99/00

USPC ..... 451/532, 533, 28, 57, 58, 523, 524

See application file for complete search history.

(56) References Cited

U.S. PATENT DOCUMENTS

| | | | | |
|---|---|---|---|---|
| 5,000,209 | A | 3/1991 | Mann | |
| 6,502,589 | B1 * | 1/2003 | Fitzgerald et al. | 134/117 |
| 6,883,989 | B2 * | 4/2005 | Kushner et al. | 401/125 |
| 6,942,552 | B2 * | 9/2005 | Lalli et al. | 451/63 |

FOREIGN PATENT DOCUMENTS

| | | |
|---|---|---|
| RU | 02196158 C1 | 10/2003 |
| SU | 800175 A1 | 1/1981 |

OTHER PUBLICATIONS

International Searching Authority, Notification of Transmittal of the International Search Report and the Written Opinion of the International Searching Authority, or the Declaration, dated Jun. 10, 2014.

* cited by examiner

*Primary Examiner* — Robert Rose

(74) *Attorney, Agent, or Firm* — Blynn L. Shideler; Krisanne Shideler; BLK Law Group

(57) ABSTRACT

A tungsten jewelry resurfacing kit for consumer end use comprises a buffing cloth; a container of tungsten resurfacing compound having less than 50 ml of resurfacing compound, wherein the resurfacing compound comprises a mixture of i) a diamond powder of at least 1000 grit size; and ii) a binder, such as a fat, which is a semi-solid at ambient temperatures. The kit may further include a plurality of swabs for removing the resurfacing compound from the container. The compound may be a mixture of about 25 to 75% by volume of a diamond powder of at least 1000 grit size; and about 25 to 75% by volume a binder, such as a fat, which is a semi-solid at ambient temperatures.

15 Claims, 1 Drawing Sheet

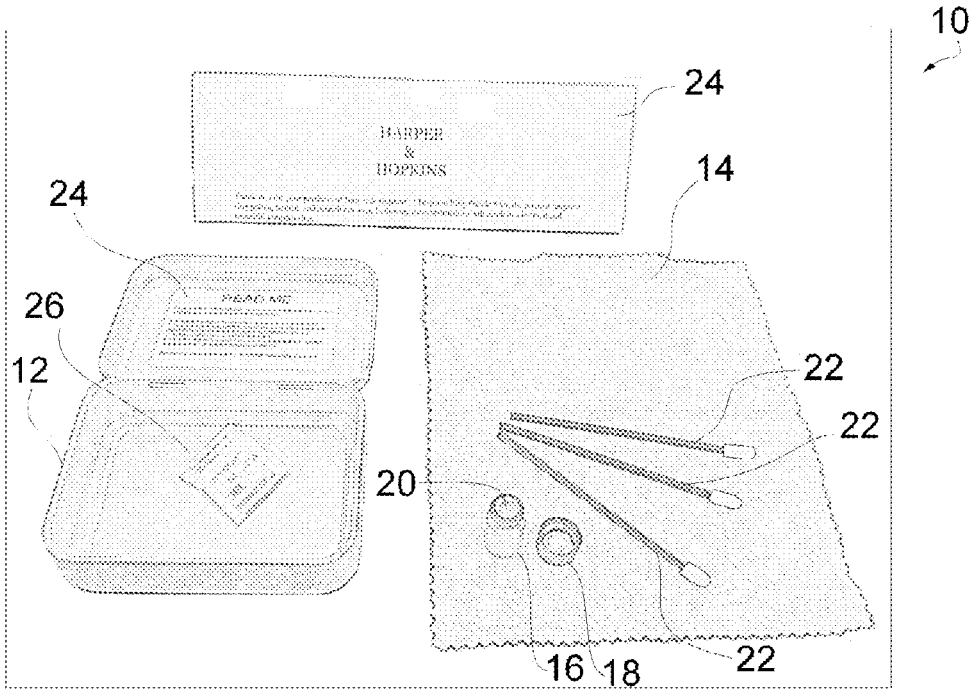
FIG. 1A
FIG. 1B
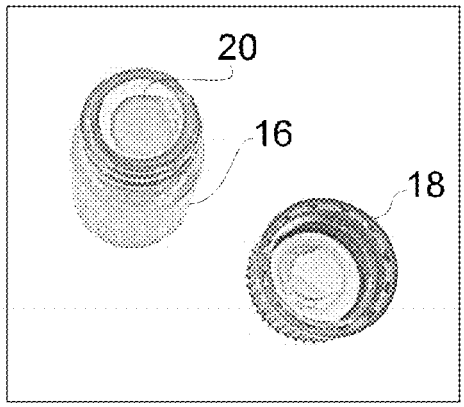

TUNGSTEN JEWELRY RESURFACING KIT FOR CONSUMER END USE AND TUNGSTEN RESURFACING COMPOUND USED THEREIN

BACKGROUND OF THE INVENTION

1. Field of the Invention

The present invention relates to a tungsten jewelry resurfacing kit for consumer end use and tungsten resurfacing compound used therein.

2. Background Information

Wearing jewelry is a form of personal adornment nearly as old as man. Some beads have been found dating back 100,000 years. Examples of common jewelry are rings, necklaces, ear rings, bracelets and watches. Jewelry has been made out of many rare and not so rare metals such as gold, silver, tin, pewter, platinum, stainless steel, titanium, and tungsten. Jewelry is often adorned with beads, gemstones, or multiple metals to make it more appealing.

There are a number of reasons why people wear jewelry. Wealth, fashion, symbolism, and protection are just a few. In many cultures, when a man and woman marry, they exchange rings, necklaces, or bracelets to symbolize their love and commitment for each other.

As mentioned, jewelry can be made from a number of different substances. As technology and fabrication techniques have improved over the years, so has the types of available metals. One of these metals, tungsten, also known as tungsten carbide, tungsten cobalt, and tungsten nickel (but can be any alloy containing a majority of tungsten) has become quite popular in the recent years.

Tungsten is very hard and rates on the Mohs hardness scale of 9, making it virtually scratch proof. Tungsten jewelry is commonly an alloy of around 85% tungsten and 15% other metals. Tungsten by itself is prone to shattering and generally these other metals are used to change the tensile strength of the overall jewelry so that it does not shatter and is easier to form in the desired shapes. Tungsten jewelry has a silvery color but can be made into different colors such as black or white by the addition of certain chemicals and metals or through various chemical processes. Once tungsten jewelry is formed, it will not bend and cannot be effectively reshaped or resized.

Both tungsten have gained increasing popularity as metals used in jewelry, such as rings, bracelets, necklaces, watch bands, watch cases and any number of other jewelry items. These items are sometimes marketed as non-tarnishing, however for a variety of reasons these items actually do become tarnished. Tungsten jewelry, such as most commonly rings, will last a lifetime if properly cared for. Like silver, tungsten is a metal which can and does tarnish. Tungsten itself does not tarnish with contact to the oxygen in the air, like silver, but instead tarnishes through contact with chemicals from daily life such as hand lotions, soaps, and food. Chemicals in the air from smog and pollution also play a small role, which allows tarnish to build up over time.

It is actually the other metals (or elements) other than tungsten in "tungsten" jewelry that is undergoing the substantial tarnishing, but the effect on the piece is the same. The tarnish on a tungsten ring is a very hard patchy dull matte gray. Scratches may also appear and be visible. Once the other metals start to break down, the tungsten jewelry develops an unattractive darkening of the metal. Eventually this metal will begin to decay, rust, and oxidize and fall out of the surface of the jewelry leaving behind small pits and groves in the ring. These pits, groves, and overall darkening of the metal cause light to scatter instead of reflect which results in dull jewelry. Further, because the tungsten metal portion of the ring is hard, it usually remains and creates a very gagged and non-shiny jewelry surface which affects the feel of the jewelry. It can be compared to a very fine sand paper. At this point, the jewelry is blotchy and molted grey with no shine or luster and definitely not what the purchaser of the jewelry envisioned. This tarnishing can happen very quickly, such as in a few months, or take time and occur over a few years.

There are very little commercially available, practical solutions for owners of such jewelry for returning these jewelry pieces to their original lustrous condition. Owners of tungsten jewelry often attempt to take their jewelry to jewelers for repair. As tungsten is nearly as hard as diamond, the typical jeweler cannot repair the jewelry as they are only set up to work on jewelry containing softer metals such as gold, silver, and platinum which rate around a 4-5 on the Mohs scale. Owners of tungsten jewelry are often told to accept the defects as "character" and jewelers even go as so far as to try to sell a new product made of a different metal. In an attempt to circumvent unhappy customers, most, if not all tungsten retailers have warranties that allow the purchaser to swap their jewelry for new jewelry should anything go wrong with the product. However, this warranty often requires the purchaser to pay a "service fee" of around $50 plus shipping both ways. As the tungsten jewelry will always degrade, the purchaser is stuck in an endless loop of paying the service fee and shipping costs to keep their jewelry looking how they were originally intended and as originally marketed. Sometimes the jewelry has a sentimental value such as a wedding ring. The purchaser does not want to have the ring replaced because it will be a different ring. It would therefore be advantageous if the ring could be refurbished.

The tarnish and unsightly nature of such jewelry can be very disconcerting for the owners, particularly where the ring is symbolic of a special relationship such as an engagement ring or a wedding ring. In these situations a damaged ring can even lead to unwanted problems extending far beyond the minor annoyance of a piece of tarnished jewelry. For example, one partner may take issue with, or misconstrue the reasons for, another partner's not wearing the unsightly, tarnished, symbolic ring; or, more humorously, one partner may take offense at another's joking about its condition, e.g., "Honey, it is now a symbol of our tainted love." In these situations there is a need for repair of the tarnished ring in an easy, prompt manner at the consumer level, and the need extends far beyond the value of specific jewelry.

It is an object of the present invention to minimize the drawbacks of the existing technology and to provide a tungsten jewelry resurfacing kit for consumer end use and tungsten resurfacing compound used therein.

SUMMARY OF THE INVENTION

One non-limiting aspect of the present invention provides a tungsten jewelry resurfacing kit for consumer end use, the kit comprising a buffing cloth; a container of tungsten resurfacing compound having less than 50 ml of resurfacing compound, wherein the resurfacing compound comprises a mixture of i) a diamond powder of at least 1000 grit size; and ii) a binder, such as for example a fat, and which binder is a semi-solid at ambient temperatures.

A further non-limiting aspect of the present invention provides a tungsten jewelry resurfacing kit for consumer end use, the kit comprising a container of tungsten resurfacing compound having less than 25 ml of resurfacing compound, wherein the resurfacing compound comprises a mixture of i) about 25 to 75% by volume of a diamond powder of at between 1500 and 5000 grit size; and ii) about 25 to 75% by volume of a binder, such as a fat, and which binder is a semi-solid at ambient temperatures; and a plurality of swabs for removing the resurfacing compound from the container.

One non-limiting aspect of the present invention provides a tungsten jewelry resurfacing compound comprising a mixture of about 25 to 75% by volume of a diamond powder of at least 1000 grit size; and about 25 to 75% by volume a binder, such as a fat, and which binder is a semi-solid at ambient temperatures.

These and other advantages of the present invention will be described in the description of the preferred embodiments taken together with the attached figures.

BRIEF DESCRIPTION OF THE FIGURES

FIG. 1A is a perspective schematic view of a tungsten jewelry resurfacing kit for consumer end use in accordance with one aspect of the present invention; and FIG. 1B is a perspective schematic view of a tungsten jewelry compound and associated container for use with the kit for consumer end use of FIG. 1A.

DESCRIPTION OF THE PREFERRED EMBODIMENTS

The present invention is directed to tungsten jewelry resurfacing kit 10 for consumer end use and the tungsten jewelry resurfacing compound used therein. The kit 10 includes a box holding a buffing cloth 14, a compound container 16 with lid 18 for holding a tungsten resurfacing compound 20 therein, a plurality of swabs 22 that are adapted to fit within the compound container for removing single use dosages, user instructions 24 lose in the box 12 and/or attached thereon, and, optionally, a desiccant 26.

As noted the various components of the tungsten jewelry resurfacing kit 10 are preferably grouped in the kit container or box 12. The box 12 may be effectively formed as a hinged lid tin as shown. A 2"×4"×1" tin forms an effective box 12 for the kit 10 which is focused on consumer use. Containers of other materials and shapes are naturally acceptable, but the metal, hinged lid tin forming box 12 as shown gives a certain permanence and ease of storage for the kit 10 for the end use consumer. This can be important as there will likely be significant time lapses or gaps between uses of the kit 10 by the consumer and thus it will be stored for a fair amount of time before all the resurfacing compound is depleted.

The buffing cloth 14 may be formed of a variety of known materials, such as a lint free micro fiber cloth or such as material used for forming jewelry polishing cloths. Jewelry polishing cloths often contain a polishing compound within the material. In alternative embodiments of the invention the cloth 14 could be imbibed with small amounts of the resurfacing compound 20, however a clean compound free cloth 14 is believed to be effective for the kit 10 of the present invention. The cloth 14 is a typical swatch size such as a 6"×7" swatch. A plurality of cloths 14 could be provided of differing materials and densities (generally varied by weave pattern and yarn size) for staged buffing, however a single cloth as shown is simple and easy for the designated consumer end use of kit 10.

The compound container 16 and associated lid 18 can take many forms. As shown container 16 is a threaded topped glass container (2.3 ml) with molded threaded lid 18, which is commonly utilized for packaging essential oils and the like. The critical aspect of the container 16 is the size, or the amount of compound 20 used in the kit 10. The present invention is intended for consumer use and has been designed accordingly. The grit size useful for consumer use for consumer jewelry resurfacing and the percentage of abrasives make large quantities of compound 20 impractical and expensive. The container 16 illustrated is 2.3 ml in size and holds enough compound for several monthly cleanings for the average consumer, who is instructed to use "½ of a pea" size of compound 20 per cleaning. Thus a container 16 of less than 4 ml, generally about 2-4 ml, would have a very long life before the compound 20 is depleted. For a consumer having multiple tungsten jewelry pieces, a 10 ml would likely be more than sufficient. The container 16, for most practical applications will be less than 25 ml and always less than 50 ml. Sizes between 25 ml and 50 ml would likely be associated with consumers having collections of tungsten jewelry.

The kit 10 includes a plurality of swabs 22 for easily removing the dosage of compound 20 from container 16. The swabs 22 are easily and effectively formed as cotton tipped plastic handles that can be used for several uses and then discarded. The provision of a plurality of swabs 22 is desirable as it prevents the user from tossing the kit 10 away before all of the compound 20 is used if a swab 22 becomes fouled or lost.

The kit 10 includes user instructions 24 within the box 12 and/or on the box 12 itself. The instructions can also direct the user to internet based sites for further instructions that can contain video demonstrations to assist the consumer. The kit 10 may further include a desiccant package 26, such as silica gel, to help preserve the actual or perceived shelf life of the kit 10. For example avoiding visible condensate on the container 16 or minimizing moisture within the cloth 14 may help avoid the consumer from concluding the kit 10 is no longer usable, when in actuality such moisture would have little or no effect on the actual operation of the resurfacing kit 10.

A key aspect of the present invention is the tungsten jewelry resurfacing compound 20 of the present invention. The compound 20 is a homogeneous mixture of about 25 to 75% by volume of a diamond powder, also called diamond grit, of at least 1000 grit size, and about 25 to 75% by volume a binder, such as a fat, and which binder is a semi-solid at ambient temperatures.

The present invention is a kit 10 designated for end use by a consumer for jewelry repair. Consequently the particle size or grit size of the diamond powder, and the volume in the compound 20, must be selected accordingly. The first consideration for the grit size selection is that it must leave an acceptable finish on jewelry. Secondly the size must be appropriate to allow a home or consumer end user to achieve reasonable results in a reasonable amount of time with manual application (i.e. a grit size requiring manual agitation for over an hour may leave a great finish but would likely be impractical to many users. The compound 20 of the present invention balances these factors and selected a grit size generally above 1000 grit size and often above 1,500 grit size and generally below 5,000 grit size. A grit size of 3,000 for the diamond powder in compound 12 is particularly effective and preferred.

| GRIT SIZE | Mean Particle Size-Micron | Mean Particle Size-Inches | Particles/Carat |
|---|---|---|---|
| 1000 | 16.5 | .00065 | $\sim 1.32 \cdot 10^7$ |
| 1100 | 14.5 | .00057 | $\sim 1.32 \cdot 10^7$ |
| 1200 | 18-12 | .00071-.00047 | $\sim 1.696 \cdot 10^7$ |
| 1400 | 10.5 | .00041 | $\sim 1.696 \cdot 10^7$ |
| 1500 | 9.5 | .00037 | $\sim 1.39 \cdot 10^8$ |
| 1800 | 12-8 | .00047-.00031 | $\sim 1.696 \cdot 10^7$-$2.62 \cdot 10^8$ |
| 2200 | 10-6 | .00039-.00024 | $\sim 7.86 \cdot 10^7$ |
| 3000 | 8-4 | .00031-.00016 | $\sim 2.62 \cdot 10^8$ |
| 5000 | 4.5 | .00018 | $\sim 8.82 \cdot 10^8$ |

As noted above the compound 20 is a homogeneous mixture of about 25 to 75% by volume of a diamond powder. A preferable range is 25-65% by volume of a diamond powder in compound 20. A more preferable range is 30-60% by volume of a diamond powder in compound 20. Specifically 50% by volume of a diamond powder in compound 20 has been used to form an effective efficient compound 20 according to the present invention. These volumes of diamond grit provide an effective compound for consumer use. The small volumes of compound necessary for consumer use for refurbishing jewelry make these volumes of diamond grit economically viable in compound 20.

The compound 20 additionally includes a binder, such as a fat, that is a semi-solid at ambient temperatures. Within the meaning of this application such a fat includes vegetable fats, and animal fats, petroleum jelly, and mixtures thereof.

A vegetable oil is a triglyceride extracted from a plant and such oils have been part of human culture for millennium. The term vegetable oil is broadly defined in this application without regard to a substance's state of matter at ambient temperatures. Within the meaning of this application, vegetable oils that are semi-solid at room temperature are called vegetable fats. Although many plant parts may yield oil, in commercial practice, oil is extracted primarily from seeds.

Animal fats and oils are lipid materials derived from animals. Physically, animal oils are liquid at room or ambient temperatures, and animal fats are semi-solid. Chemically, both animal fats and animal oils are composed of triglycerides. Animal fat has a melting temperature of about 184° C., and a boiling point of around 200° C. (and an ignition point of 280° C. where it will burst into flames without spark).

Petroleum jelly (also known as petrolatum, white petrolatum, soft paraffin or multi-hydrocarbon) is a mixture of hydrocarbons, having a melting point usually within a few degrees of human body temperature, which is approximately 37° C. (99° F.). Petroleum jelly is generally either colorless, or of a pale yellow color (when not highly distilled), translucent, and devoid of taste and smell when pure. Petroleum jelly does not oxidize on exposure to the air and is not readily acted on by chemical reagents.

The compound 20 includes only the diamond powder or grit and the binder, so the compound 20 includes about 25 to 75% by volume of the binder. A preferable range is 35-75% by volume of the binder in compound 20. A more preferable range is 40-70% by volume of the binder in compound 20. Specifically 50% by volume of the binder in compound 20 has been used to form an effective efficient compound 20 according to the present invention.

The use of vegetable fats, and animal fats, petroleum jelly, and mixtures thereof for forming the binder in compound 20 allows for easy formulation of the compound. The binder may be heated until a liquid, or more liquid phase is present and the diamond powder added thereto and the mixture is mixed or agitated to achieve a homogeneous mixture. The compound is allowed to cool to a semi-solid or paste. Agitation or mixing may be maintained during cooling to maintain a homogeneous mixture, and to prevent the settling of the diamond powder.

The semi-solid nature of the fat binder allows for other economic manufacturing of the compound 20. A mixing mill, namely a large scale mortar and pestle can be used as the diamond powder will not be crushed, can be used to form a homogeneous mixture. Various mixing techniques can be used, with the detrimental effects of the diamond powder on the mixing equipment being more of a limiting factor in process selection.

The kit 10 allows for easy hand refurbishing or resurfacing of tungsten jewelry or through use of a hand tool such as a Dremel® tool. Hand polishing with the kit 10 is an easy way for consumers to keep their tungsten jewelry looking good. As an initial step consumers use the foam swab 22 to remove a small amount (about the size of ½ of a pea) of the compound 20 from container 16 and place it on their jewelry, such as a ring. Secondly, using the cloth 14 included in the kit 10, users rub the compound into the jewelry, e.g., ring, with pressure.

As, tungsten is a very hard metal, users will be reminded in instructions 24 that "it will take some pressure to remove the tarnish" and that they "will start to see [their] cloth turn black or a dark gray. This is the tarnish being removed from your ring." For the final step, users will rub in straight lines along the length of the ring or other jewelry. This helps the light reflect optimally to achieve a mirror finish. The instructions 24 will remind users of the important fact that "the more you rub and the harder you rub, the shiner your ring will become" and that as a small amount of compound 20 goes a long way they should "keep using the same spot on the polishing cloth as long as possible."

The kit 10 allows for removing heavy tarnish with a machine assist. The use of an assisting rotary tool is helpful if hand resurfacing is not working for a particular consumer or where speed is of significant concern. Using a hand-held rotary tool such as a Dremel® rotary tool along with a fabric polishing wheel attachment with the kit 10 may be the quickest and easiest way to polish a tungsten ring or other jewelry. Using a rotary hand tool will enable users to remove even the heaviest tarnish in only a few minutes. It is the easiest way to get a mirror finish.

The process is similar to manual resurfacing above in that first, using the foam swab 22 the user removes a small amount (again about the size of ½ of a pea) of compound 20. Here the user will place the unit dose of compound 20 around the felt polishing pad of the rotary tool and they should rub it in so that it does not spin off once the tool is started. The users should then start the tool on low or medium speed, and after the tool has achieved speed, place the felt polishing pad against the ring or other jewelry piece with slight pressure. The users may observe the felt pad turning gray or black which is a sign of the tarnish being removed. The users should work their way around the ring or other piece and always keep moving and try not to stay on any one spot for any length of time. After a minute or two, the users can wash the ring or other piece with soap and water to check the progress. Should they observe that some spots have been missed they place a little more compound 20 onto the tools felt pad and work on those areas until the ring or other piece is a uniform brilliance.

Once an item is resurfaced users may wish to repeat every month or few months or so by repeating the above manual or machine aided steps. Users can be advised that if the subject jewelry has any inlaid metal such as gold or platinum, be careful not to rub it with the polish. Merely getting the polish on the gold or platinum will not harm or dissolve it, but rubbing will remove the metal. Further users may be cautioned that if the subject jewelry has any type of laser engraved design users must be very careful polishing as the tarnish remover removes a very thin layer (the tarnished metal) from the jewelry and if their design is not very deep, they can risk removing the design.

As discussed in detail above tungsten jewelry can only be effectively refurbished by removing the top layer of tungsten metal. This can be accomplished by smoothing the jewelry using the abrasive diamond powder in the compound 20 that is harder than the tungsten. Buffing is done by passing the abrasive particle over the jewelry (or jewelry over an abrasive particle) either by hand or machine. Each pass of the abrasive removes a layer of the damaged jewelry. As mentioned, tungsten jewelry is often an alloy or mixture of metals. These other metals are prone to rusting and often leave pits and groves in the ring. The abrasive must remove and make the surface even between the tungsten and the additional metal so that there is an even surface.

For the compound to work, it must contain an abrasive that is harder than tungsten. Tungsten is extremely hard and there are only a few known elements and compounds that are harder. Diamonds, including artificial diamonds, for example are the hardest known material to man and thus the diamond grit, which is easily available. Other elements and compounds are carborundum, corundum, boron, boron nitride, rhenium diboride, stishovite, titanium diboride, carbonado. This list is not meant to be all encompassing. New elements and compounds are being discovered all the time. The only requirement is that the buffing compound be harder than the tungsten jewelry. However the wide availability of diamond powder or grit makes this a highly suitable component for compound 20.

In the practice of the present invention, there is provided a buffing compound that contains a minimum percentage of an abrasive that is harder than tungsten and a binder or carrier to suspend the abrasive. The carrier or binder can be oil, grease, or other compound that keeps the abrasive in suspension or distributes said abrasive into suspension by shaking. It can also include a low friction powder or anti-caking agent (an agent meant to stop the abrasive from binding and sticking to itself and also extends in volume the overall product).

As mentioned, it would be advantageous for the owner of the jewelry to be able to repair their own jewelry at will. Normally when tungsten rings are created they are buffed with expensive buffing machines that are not available to the owner of the jewelry or even jewelers. One embodiment of the present invention utilizes a buffing compound that contains a high amount of abrasives so that the jewelry owner can buff the jewelry by hand. The large amount of abrasives allows for quicker and easier removal of tarnish and other defects. The current formulation is 50% by volume. The current invention can utilize lower amounts of abrasives as long as the amount of time to repair the jewelry is not exorbitant. As mentioned, tungsten jewelry is very hard. When buffing by hand it may take the jewelry owner an exorbitant amount of time and effort to remove the top layer of metal and buff to a acceptable shine. Thus one embodiment of the present invention is an apparatus used to repair tungsten jewelry. This apparatus is a kit that contains the buffing compound and a polishing cloth. The cloth is placed on a hard surface such as a table top, placing the buffing compound on the jewelry, and then rapidly rubbing the jewelry back and forth over the cloth while applying pressure against the hard surface. This allows the owner to apply more pressure than would be possible by simply holding the jewelry. This method removes the tarnish more quickly, and also allows the jewelry owner to achieve a high shine and luster which would not be otherwise achievable by hand without a lot of effort and time. The buffing compound could be contained in a bottle for storage or it could also be pre-applied to the cloth.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention is defined in the appended claims and equivalents thereto.

What is claimed is:

1. A tungsten jewelry resurfacing kit for consumer end use, the kit comprising:

A) A buffing cloth;

B) A container of tungsten resurfacing compound having less than 50 ml of resurfacing compound, wherein the resurfacing compound comprises a mixture of i) a diamond powder of at least 1000 grit size; and ii) a binder which is a semi-solid at ambient temperatures, wherein the binder is a vegetable fat.

2. The tungsten jewelry resurfacing kit according to claim 1, further including a plurality of swabs for removing the resurfacing compound from the container.

3. The tungsten jewelry resurfacing kit according to claim 1, wherein the diamond powder is of at between 1500 and 5000 grit size.

4. The tungsten jewelry resurfacing kit according to claim 3, wherein the diamond powder is about 3000 grit size.

5. The tungsten jewelry resurfacing kit according to claim 3, wherein the diamond powder is 25-65% by volume of the resurfacing compound.

6. The tungsten jewelry resurfacing kit according to claim 5, wherein the diamond powder is 35-60% by volume of the resurfacing compound.

7. The tungsten jewelry resurfacing kit according to claim 6, wherein the diamond powder is about 50% by volume of the resurfacing compound.

8. The tungsten jewelry resurfacing kit according to claim 5, wherein the container holds less than 10 ml of resurfacing compound.

9. A tungsten jewelry resurfacing compound comprising a mixture of

A) about 25 to 75% by volume of a diamond powder of at least 1000 grit size; and B) about 25 to 75% by volume a binder which is a semi-solid at ambient temperatures, wherein the binder is a vegetable fat.

10. The tungsten jewelry resurfacing compound according to claim 9, wherein the diamond powder is of at between 1500 and 5000 grit size.

11. The tungsten jewelry resurfacing compound according to claim 10, wherein the diamond powder is about 3000 grit size.

12. The tungsten jewelry resurfacing compound according to claim 11, wherein the diamond powder is less than 65% by volume of the resurfacing compound.

13. The tungsten jewelry resurfacing compound according to claim 12, wherein the diamond powder is greater than 35% by volume of the resurfacing compound.

14. The tungsten jewelry resurfacing compound according to claim 13, wherein the diamond powder is about 50% by volume of the resurfacing compound.

15. A tungsten jewelry resurfacing kit for consumer end use, the kit comprising:

A) a container of tungsten resurfacing compound having less than 25 ml of resurfacing compound, wherein the resurfacing compound comprises a mixture of i) about 25 to 75% by volume of a diamond powder of at between 1500 and 5000 grit size; and ii) about 25 to 75% by volume of a binder which is a semi-solid at ambient temperatures, wherein the binder is a fat and the container holds less than 4 ml of resurfacing compound; and B) a plurality of swabs for removing the resurfacing compound from the container.

* * * * *